US009441648B2

(12) United States Patent
Fukuda et al.

(10) Patent No.: US 9,441,648 B2
(45) Date of Patent: Sep. 13, 2016

(54) CONTROL SYSTEM FOR A HYBRID CONSTRUCTION MACHINE

(71) Applicant: KAYABA INDUSTRY CO., LTD., Tokyo (JP)

(72) Inventors: Shunsuke Fukuda, Kanagawa (JP); Nobuyoshi Yoshida, Tokyo (JP)

(73) Assignee: KYB Corporation, Tokyo (JP)

( * ) Notice: Subject to any disclaimer, the term of this patent is extended or adjusted under 35 U.S.C. 154(b) by 273 days.

(21) Appl. No.: 14/373,945

(22) PCT Filed: Jan. 21, 2013

(86) PCT No.: PCT/JP2013/051101
§ 371 (c)(1),
(2) Date: Jul. 23, 2014

(87) PCT Pub. No.: WO2013/111707
PCT Pub. Date: Aug. 1, 2013

(65) Prior Publication Data

US 2015/0033726 A1 Feb. 5, 2015

(30) Foreign Application Priority Data

Jan. 25, 2012 (JP) ..... 2012-013185

(51) Int. Cl.

| | |
|---|---|
| ***F15B 21/14*** | (2006.01) |
| ***E02F 9/22*** | (2006.01) |
| ***F15B 11/17*** | (2006.01) |
| ***E02F 9/20*** | (2006.01) |
| ***F15B 11/02*** | (2006.01) |

(52) U.S. Cl.
CPC ..... *F15B 21/14* (2013.01); *E02F 9/2095* (2013.01); *E02F 9/2217* (2013.01); *E02F 9/2242* (2013.01); *E02F 9/2285* (2013.01); *E02F 9/2292* (2013.01); *E02F 9/2296* (2013.01); *F15B 11/02* (2013.01); *F15B 11/17* (2013.01); *F15B 2211/20576* (2013.01); *F15B 2211/61* (2013.01); *F15B 2211/88* (2013.01)

(58) Field of Classification Search
CPC ..... F15B 11/17; F15B 21/14; F15B 2211/20576; E02F 9/2075; E02F 9/2292; E02F 9/2239; E02F 9/2242
See application file for complete search history.

(56) References Cited

U.S. PATENT DOCUMENTS 8,321,095 B2 * 11/2012 Kawasaki ..... E02F 9/2075 701/36
2009/0288408 A1 * 11/2009 Tozawa ..... E02F 9/2075 60/435

FOREIGN PATENT DOCUMENTS

| | | | |
|---|---|---|---|
| JP | 63-99003 | U | 6/1988 |
| JP | 09-151488 | A | 6/1997 |
| JP | 09-151489 | A | 6/1997 |
| JP | 2002-339904 | A | 11/2002 |
| JP | 2011-241947 | A | 12/2011 |

* cited by examiner

*Primary Examiner* — Michael Quandt
(74) *Attorney, Agent, or Firm* — Rabin & Berdo, P.C.

(57) ABSTRACT

A control system for a hybrid construction machine includes first and second main pumps, first and second supply passages, first and second circuit systems, a hydraulic motor, a motor generator, an assist pump, a joint passage connected to the assist pump and branching off, first and second logic valves, and a switching valve. The switching valve switches between a state where the assist pump is connected to the second supply passage and a state where the second main pump is connected to the hydraulic motor. A bypass passage branches off from the other branch passage at the downstream of the switching valve. The bypass passage is connected to the second supply passage on the downstream side of the second logic valve.

3 Claims, 2 Drawing Sheets

CONTROL SYSTEM FOR A HYBRID CONSTRUCTION MACHINE

TECHNICAL FIELD

This invention relates to a control system for a hybrid construction machine.

BACKGROUND ART

JP2011-241947A discloses a hybrid construction machine capable of adding a discharge pressure of an assist pump driven by a motor to discharge pressures of main pumps driven by an engine. The hybrid construction machine includes a first and a second variable-capacity type main pump.

The first main pump is connected to a first circuit system by way of a first supply passage and a plurality of operation valves are connected to the first circuit system. An output port of a first logic valve is connected to the first supply passage. An input port of the first logic valve constantly communicates with the variable-capacity type assist pump by way of a joint passage.

The second main pump is connected to a second circuit system by way of a second supply passage and a plurality of operation valves are connected to the second circuit system. A second logic valve is disposed in the second supply passage. An input port of the second logic valve is connected to the second main pump via the second supply passage on the upstream side of the second logic valve. An output port of the second logic valve is connected to the second circuit system via the second supply passage on the downstream side of the second logic valve.

The assist pump of the variable-capacity type integrally rotates with a hydraulic motor and a motor generator of the variable-capacity type in coordination with them. The motor generator is connected to a battery via an inverter. Thus, if the hydraulic motor rotates, the motor generator rotates to generate power and the generated power is stored into the battery via the inverter.

A switching valve is connected to the second supply passage. The switching valve is normally kept at a neutral position by the action of a centering spring and allows a joint passage communicating with the assist pump to communicate with the second supply passage by way of a branch passage. A check valve for permitting only a flow from the switching valve to the second supply passage is provided in the branch passage.

Accordingly, when the switching valve is at the neutral position, the first and second logic valves are connected in parallel to the joint passage.

SUMMARY OF INVENTION

In the above conventional technology, the assist pump is connected in parallel to the first and second main pumps via the joint passage. Out of these, the assist pump is connected to the second main pump via the branch passage including the check valve. Since the opening of the check valve is limited, a pressure loss in a path from the assist pump to the second main pump becomes larger than a pressure loss in a path from the assist pump to the first main pump, whereby a pressure balance between the both may be possibly lost.

If the pressure balance is lost, the operation feeling of an operator may be possibly deteriorated when the operation valves are operated by causing discharged oil from the assist pump to join discharged oil from the first and second main pumps.

It is an object of the present invention to provide a control system for a hybrid construction machine capable of keeping a balance of pressures joining a first main pump and a second main pump when an assist pump driven using a power source different from the one for the first and second main pumps is connected in parallel to the first and second main pumps.

According to one aspect of the present invention, a hybrid construction machine is provided. The hybrid construction machine includes a first main pump and a second main pump, a first circuit system connected to the first main pump via a first supply passage, a second circuit system connected to the second main pump via a second supply passage, a hydraulic motor connected to the second main pump, a motor generator adapted to be rotated by a drive force of the hydraulic motor, an assist pump adapted to be rotated by a drive force of the motor generator, a joint passage connected to the assist pump and branching off at an intermediate position into one branch passage and another branch passage, a first logic valve disposed between the one branch passage and the first supply passage, a second logic valve disposed in the second supply passage, a switching valve disposed in the other branch passage and switchable to a state where the assist pump is connected to the second supply passage on the upstream side of the second logic valve and a state where the second main pump is connected to the hydraulic motor, and a bypass passage further branched off from the other branch passage at a side downstream of the switching valve. The bypass passage is connected to the second supply passage on the downstream side of the second logic valve.

Embodiments of the present invention and advantages thereof are described in detail below with reference to the accompanying drawings.

DESCRIPTION OF EMBODIMENTS

Hereinafter, an embodiment of the present invention is described with reference to the drawings.

Figure 1:
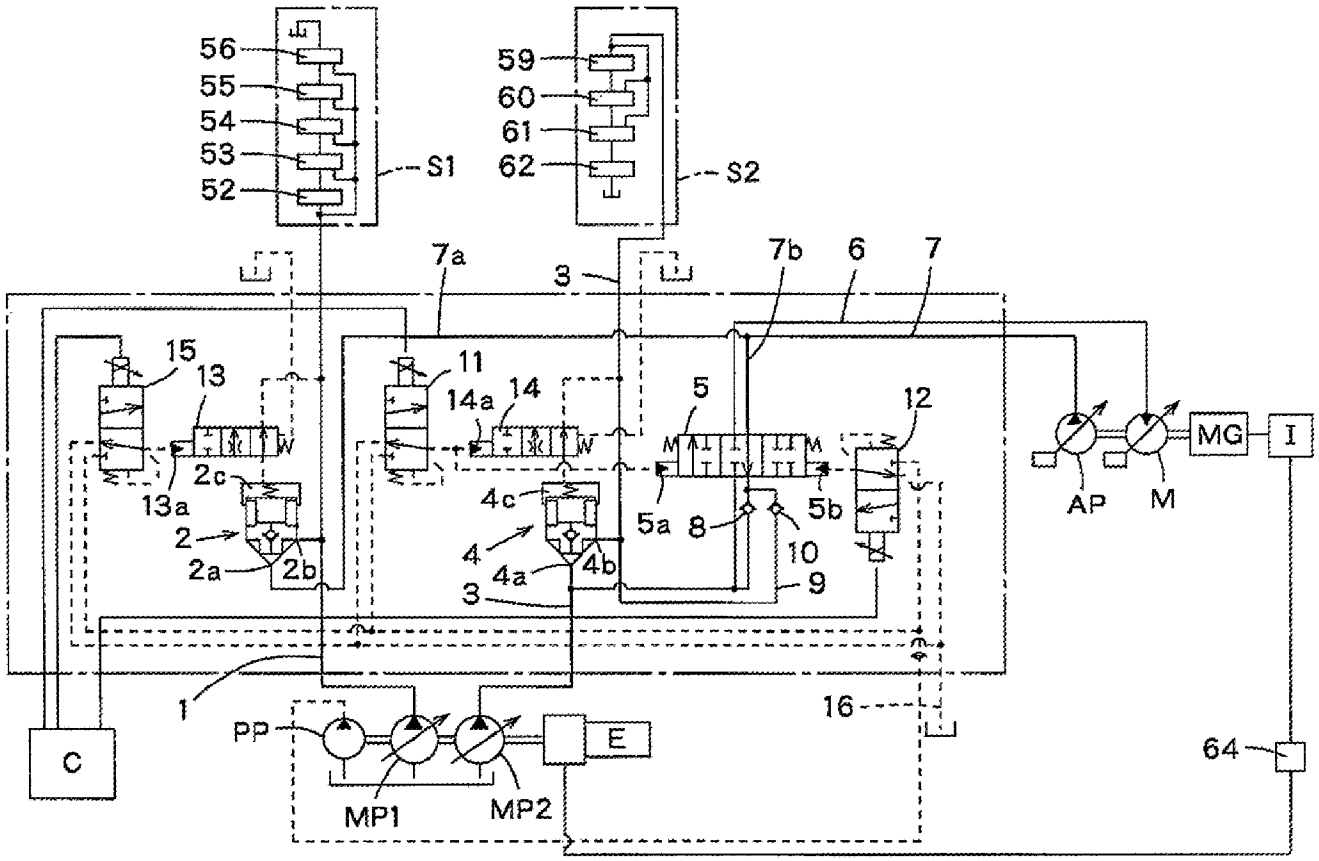
FIG. 1 is a circuit diagram showing a hydraulic control system, e.g., a control circuit of a hybrid construction machine according to an embodiment of the present invention.

FIG. 1 is a circuit diagram showing a hydraulic control circuit of a hybrid construction machine according to the embodiment of the present invention. A first main pump MP1 and a second main pump MP2 of a variable-capacity type are provided in the hydraulic control circuit.

The first main pump MP1 is directly connected to a first circuit system S1 via a first supply passage 1. Out of an input port 2*a* and an output port 2*b* provided in a first logic valve 2, the output port 2*b* is connected to the first supply passage 1. A plurality of operation valves 52 to 56 are connected to the first circuit system S1.

The second main pump MP2 is directly connected to a second circuit system S2 by way of a second supply passage 3. A second logic valve 4 is provided at an intermediate position of the second supply passage 3. An input port 4*a* of the second logic valve 4 is connected to the second supply passage 3 on the upstream side of the second logic valve 4 and an output port 4*b* of the second logic valve 4 is connected to the second supply passage 3 on the downstream side of the second logic valve 4. A plurality of operation valves 59 to 62 are connected to the second circuit system.

Further, the hydraulic control circuit includes an assist pump AP in addition to the first and second main pumps MP1, MP2. The assist pump AP is rotated by a drive force of a motor generator MG. The motor generator MG is rotated by a drive force of a hydraulic motor M. The hydraulic motor M is connected to the second supply passage 3 on the upstream side of the second logic valve 4 by way of a connection passage 6 connected to a switching valve 5.

The motor generator MG is connected to a battery 64 via an inverter I. Accordingly, if the hydraulic motor M rotates, the motor generator MG rotates to generate power and the generated power is stored into the battery 64 via the inverter I.

A joint passage 7 is connected to the assist pump AP. The joint passage 7 branches off into a branch passage 7*a* and a branch passage 7*b*. One branch passage 7*a* is directly connected to the input port 2*a* of the first logic valve 2. The other branch passage 7*b* is connected to the second supply passage 3 on the upstream side of the second logic valve 4 by way of the switching valve 5 and a check valve 8 provided downstream of the switching valve 5. The check valve 8 permits only a flow from the assist pump AP to the second supply passage 3.

The switching valve 5 is a three-position switching valve and keeps the branch passage 7*b* in a state of communication and cuts off the connection passage 6 when being at a shown neutral position. This causes discharged oil from the assist pump AP to be supplied to the input port 2*a* of the first logic valve 2 by way of the one branch passage 7*a* and to the second supply passage 3 on the upstream side of the second logic valve 4 by way of the other branch passage 7*b*.

When the switching valve 5 is switched to a shown left position, the branch passage 7*b* is cut off and the connection passage 6 is set in a state of communication. This allows the second supply passage 3 on the upstream side of the second logic valve 4 to communicate with the hydraulic motor M via the connection passage 6.

When the switching valve 5 is switched to a shown right position, both the connection passage 6 and the branch passage 7*b* are cut off.

Figure 2:
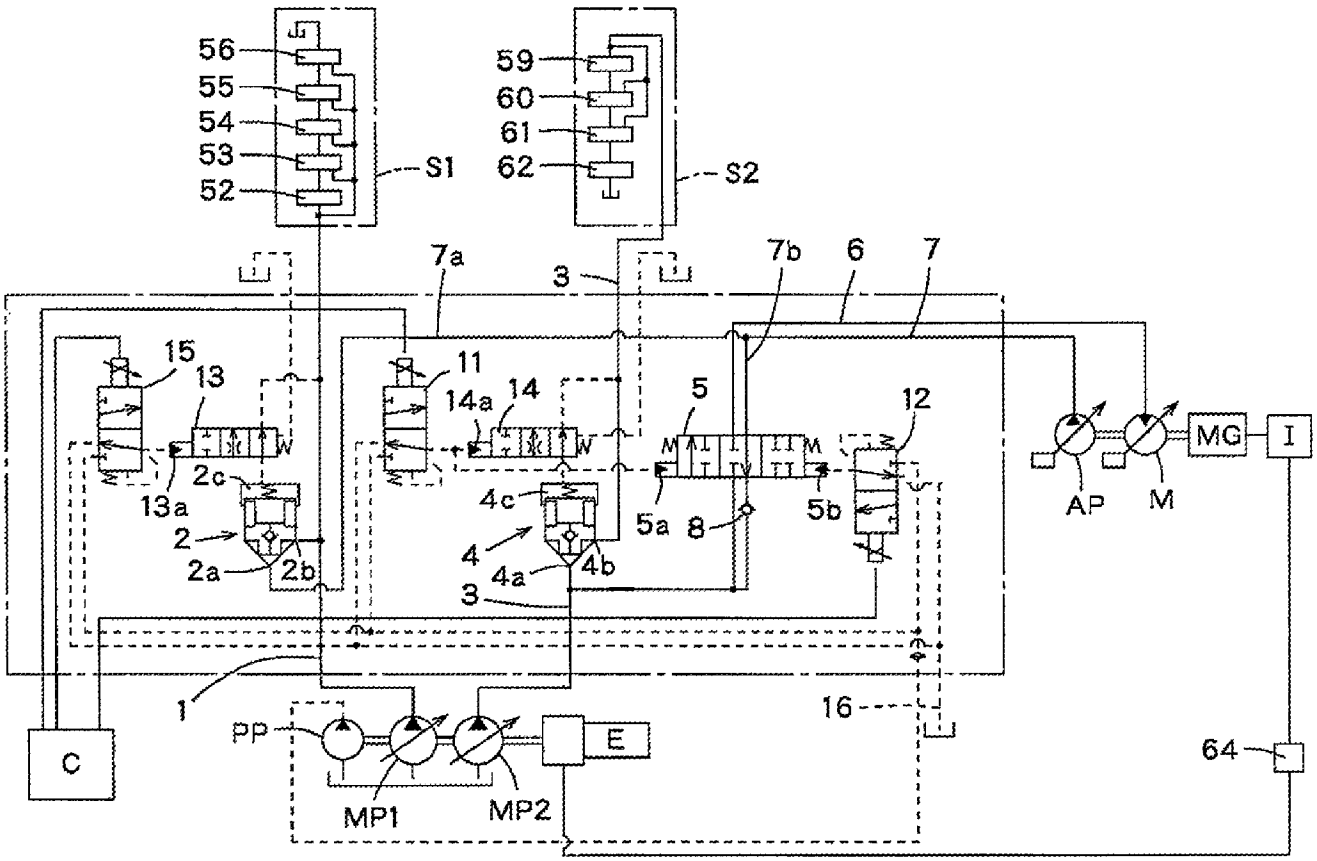
FIG. 2 is a circuit diagram showing a hydraulic control circuit of a hybrid construction machine in a comparative example.

Here, as shown in a comparative example of FIG. 2, the assist pump AP is connected to the second main pump MP2 via the branch passage 7*b* including the check valve 8. Since the opening of the check valve 8 is limited, a pressure loss in a path from the assist pump AP to the second main pump MP2 becomes larger than a pressure loss in a path from the assist pump AP to the first main pump MP1, whereby a pressure balance between the both may be possibly lost.

If the pressure balance is lost, the operation feeling of an operator may be possibly deteriorated when the operation valves 52 to 56 and 59 to 62 are operated by causing the discharged oil from the assist pump AP to join discharged oil from the first and second main pumps MP1, MP2.

Accordingly, as shown in FIG. 1, the branch passage 7*b* includes a bypass passage 9 branching off between the switching valve 5 and the check valve 8 in the present embodiment. The bypass passage 9 is directly connected to the second supply passage 3 on the downstream side of the second logic valve 4. A check valve 10 for permitting only a flow from the assist pump AP to the second supply passage 3 on the downstream side of the second logic valve 4 is provided in the bypass passage 9.

The switching valve 5 includes a pilot chamber 5*a* and a pilot chamber 5*b*, an electromagnetic switching valve 11 is connected to the pilot chamber 5*a* and an electromagnetic switching valve 12 is connected to the pilot chamber 5*b*. A pilot pressure from a pilot pump PP is introduced to the switching valve 5 via the electromagnetic switching valves 11, 12. The switching valve 5 is switched to any one of the neutral position, the left position and the right position by the action of the pilot pressure.

A pilot chamber 2*c* of the first logic valve 2 is connected to the first supply passage 1 via an on-off valve 13. A pilot chamber 4*c* of the second logic valve 4 is connected to the second supply passage 3 via an on-off valve 14. The on-off valves 13, 14 have a fully open position, a closed position and a throttle control position and are switched to the fully open position, the closed position or the throttle control position according to a pilot pressure in the corresponding pilot chambers 13*a*, 14*a*.

Electromagnetic switching valves 11, 15 are connected to the respective pilot chambers 13*a*, 14*a* of the on-off valves 13, 14. The on-off valves 13, 14 are switched by the pilot pressure from the pilot pump PP introduced via the electromagnetic switching valves 11, 15. The electromagnetic switching valve 11 is also connected to one pilot chamber 5*a* of the switching valve 5.

When the electromagnetic switching valve 11 is at a neutral position shown in FIG. 1, the pilot chamber 5*a* of the switching valve 5 and the pilot chamber 14*a* of the on-off valve 14 respectively communicate with a drain passage 16. On the other hand, when a solenoid of the electromagnetic switching valve 11 is excited by a control signal from a controller C, the electromagnetic switching valve 11 is switched to a switch position. In this way, the pilot pressure of the pilot pump PP is introduced to the both pilot chambers 5*a*, 14*a*.

When the electromagnetic switching valve 15 is at a neutral position shown in FIG. 1, the pilot chamber 13*a* of the on-off valve 13 communicates with the drain passage 16. On the other hand, when a solenoid of the electromagnetic switching valve 15 is excited by a control signal from the controller C, the electromagnetic switching valve 15 is switched to a switch position. In this way, the pilot pressure of the pilot pump PP is introduced to the pilot chamber 13*a* of the on-off valve 13.

The controller C outputs a control signal corresponding to the operation of the operator. The operator can switch each of the electromagnetic switching valves 11, 12 and 15 to the switch position simultaneously and can also switch them individually.

Next, functions of the present embodiment are described.

In the case of causing the motor generator MG to fulfill a power generation function, the controller C outputs a control signal to switch the electromagnetic switching valve 11 to the switch position. When the electromagnetic switching valve 11 is switched to the switch position, the pilot pressure of the pilot pump PP is introduced to each of the one pilot chamber 5*a* of the switching valve 5 and the pilot chamber 14*a* of the on-off valve 14. At this time, the controller C keeps a solenoid of the electromagnetic switching valve 12 in a non-exciting state and allows the other pilot chamber 5*b* of the switching valve 5 to communicate with the drain passage 16.

When the pilot pressure is introduced to the pilot chamber 14*a* of the on-off valve 14, the on-off valve 14 is switched to the closed position by the action of the pressure in the pilot chamber 14*a*. Then, the pilot chamber 4*c* of the second logic valve 4 is closed, wherefore the second logic valve 4 is kept in a closed state.

Accordingly, the discharged oil from the second main pump MP2 is supplied to the hydraulic motor M by way of the connection passage 6 and the switching valve 5 without being introduced to the second circuit system S2, thereby rotating the hydraulic motor M. If the hydraulic motor M rotates, the motor generator MG rotates to generate power and the generated power is stored into the battery 64 via the inverter I.

On the other hand, in the case of causing the discharged oil from the assist pump AP to join the discharged oil from the first and second main pumps MP1, MP2, the controller C outputs a control signal to set all of the solenoids of the electromagnetic switching valves 11, 12 and 15 in the non-exciting state. In this way, the electromagnetic switching valves 11, 12 and 15 are kept at the shown neutral position and the pilot chambers 5*a*, 5*b* of the switching valve 5 and the pilot chambers 13*a*, 14*a* of the on-off valves 13, 14 communicate with the drain passage 16.

Since the pilot chamber 13*a* of the on-off valve 13 communicates with the drain passage 16 as described above, the on-off valve 13 is kept at the fully open position that is the shown neutral position. If the discharged oil from the assist pump AP flows into the first logic valve 2 from the branch passage 7*a* in this state, the first logic valve 2 is opened.

Thus, the discharged oil from the assist pump AP supplied to the branch passage 7*a* joins the first supply passage 1 by way of the first logic valve 2 and is supplied to the first circuit system 51.

Further, since the pilot chambers 5*a*, 5*b* of the switching valve 5 communicate with the drain passage 16 as described above, the switching valve 5 is kept at the shown neutral position and the branch passage 7*b* of the joint passage 7 and the bypass passage 9 communicate with the assist pump AP. At this time, since the pilot chamber 14*a* of the on-off valve 14 also communicates with the drain passage 16, the on-off valve 14 is kept at the fully open position that is the shown neutral position. If the on-off valve 14 is kept at the fully open position, the pilot chamber 4*c* of the second logic valve 4 communicates with the second supply passage 3, wherefore a pressure in the branch passage 7*b* acts on the second logic valve 4 to open the second logic valve 4.

Thus, the discharged oil from the assist pump AP is supplied from the branch passage 7*b* to the second circuit system S2 by way of the second logic valve 4 and directly supplied to the second circuit system S2 through the bypass passage 9.

Since the discharged oil from the assist pump AP is supplied to the second circuit system S2 by way of two passages, i.e. the branch passage 7*b* and the bypass passage 9 as just described, the pressure loss becomes relatively smaller.

It should be noted that since the check valve 10 is also provided in the bypass passage 9, a pressure loss of the bypass passage 9 also depends on the opening of the check valve 10. However, since the sum of the openings of the check valve 8 in the branch passage 7*b* and the check valve 10 in the bypass passage 9 corresponds to a flow passage area, the pressure loss is smaller than in the case where there is only the branch passage 7*b*.

Accordingly, the deterioration of the pressure balance between the first and second circuit systems S1, S2 can be suppressed.

Further, it is also possible to control the opening of the electromagnetic switching valve 11 or 15 and keep either one of the on-off valves 13, 14 at the throttle control position between the closed position and the fully open position by the controller C outputting a control signal according to the operation of the operator. In this case, the opening of the first or second logic valve 2 or 4 can be controlled according to throttle opening.

Accordingly, the pressures of the first and second circuit systems S1, S2 can be controlled in a comprehensive manner, for example, by reducing the opening of the first logic valve 2 and actively increasing the pressure loss at the first logic valve 2 side.

Besides, the pressures of the first and second circuit systems S1, S2 can be controlled as necessary by changing a combination of the openings of the on-off valves 13, 14. For example, in the case of newly adding an assist pump to an existing system, an operator can operate with almost the same feeling as the operation feeling of the existing system by controlling the on-off valves 13, 14.

That is, according to the present embodiment, a comfortable operation can be realized without deteriorating the operation feeling of the operator.

It should be noted that a pilot pressure for keeping the on-off valve 14 at the throttle control position is set at a pressure in a range to keep the switching valve 5 at or near the shown neutral position. In this way, the on-off valve 14 can be kept at the throttle control position and it can be prevented that the switching valve 5 is switched to a position other than the neutral position and the discharged oil from the assist pump AP is not introduced to the second logic valve 4.

Further, if the electromagnetic switching valve 11 is kept at the shown neutral position and the electromagnetic switching valve 12 is switched to the switch position, the one pilot chamber 5*a* of the switching valve 5 communicates with the drain passage 16 and the other pilot chamber 5*b* communicates with the pilot pump PP. Accordingly, the switching valve 5 is switched to the shown right position to cut off the communication between the hydraulic motor M and the second main pump MP2, between the assist pump AP and the side downstream of the branch passage 7*b*, and between the assist pump AP and the bypass passage 9. Thus, the discharged oil from the assist pump AP is supplied only to the first logic valve 2 by way of the branch passage 7*a*.

The embodiments of the present invention described above are merely illustration of some application examples of the present invention and not of the nature to limit the technical scope of the present invention to the specific constructions of the above embodiments.

The present application claims a priority based on Japanese Patent Application No. 2012-013185 filed with the Japan Patent Office on Jan. 25, 2012, all the contents of which are hereby incorporated by reference.

The invention claimed is:

1. A control system for hybrid construction machine, comprising:

a first main pump and a second main pump;

a first circuit system connected to the first main pump via a first supply passage;

a second circuit system connected to the second main pump via a second supply passage;

a hydraulic motor connected to the second main pump;

a motor generator adapted to be rotated by a drive force of the hydraulic motor;

an assist pump adapted to be rotated by a drive force of the motor generator;

a joint passage connected to the assist pump and branching off at an intermediate position into one branch passage and another branch passage;

a first logic valve disposed between the one branch passage and the first supply passage;

a second logic valve disposed in the second supply passage;

a switching valve disposed in the other branch passage and switchable to a state where the assist pump is connected to the second supply passage on the upstream side of the second logic valve and a state where the second main pump is connected to the hydraulic motor; and a bypass passage further branched off from the other branch passage at a side downstream of the switching valve, wherein the bypass passage is connected to the second supply passage on the downstream side of the second logic valve.

2. The control system for hybrid construction machine according to claim 1, wherein:

a check valve for permitting only a flow from the assist pump to the second logic valve is provided at the other branch passage of the downstream side of a branching point with the bypass passage; and a check valve for permitting only a flow from the assist pump to the second circuit system is provided in the bypass passage.

3. The control system for hybrid construction machine according to claim 1, wherein:

an on-off valve is provided in at least one of a pilot chamber for adjusting the opening of the first logic valve and a pilot chamber for adjusting the opening of the second logic valve; and the on-off valve is switchable to any one of a fully open position, a closed position and a throttle control position.

* * * * *